US006394588B2

(12) United States Patent
Moon et al.

(10) Patent No.: US 6,394,588 B2
(45) Date of Patent: May 28, 2002

(54) INK JET PRINTER HEAD

(75) Inventors: Jae-Ho Moon; O-Keun Kwon, both of Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/845,152

(22) Filed: May 1, 2001

(30) Foreign Application Priority Data

Jul. 27, 2000 (KR) ..... 00-43462

(51) Int. Cl.[7] ..... B41J 2/05; B41J 2/17
(52) U.S. Cl. ..... 347/65; 347/94
(58) Field of Search ..... 347/63, 65, 92, 347/94

(56) References Cited

U.S. PATENT DOCUMENTS 5,412,413 A * 5/1995 Sekiya et al. ..... 347/65

6,010,208 A * 1/2000 Powers et al. ..... 347/65

* cited by examiner

*Primary Examiner*—John Barlow
*Assistant Examiner*—Juanita Stephens
(74) *Attorney, Agent, or Firm*—Robert E. Bushnell, Esq.

(57) ABSTRACT

An ink flow path of improved structure in an ink jet printer head includes a first ink channel formed at a right angle to an ink supply path in parallel relation with an ink chamber, a second ink channel formed at a right angle to the first ink channel in parallel relation with the ink supply path across the ink chamber, and a third ink channel connecting the second ink channel to a rear side of the ink chamber of which front side faces the ink supply path. Accordingly, a backflow of ink is prevented during the ink discharge through a nozzle hole, thus print quality is improved.

20 Claims, 3 Drawing Sheets

INK JET PRINTER HEAD

CLAIM OF PRIORITY

This application makes reference to, incorporates the same herein, and claims all benefits accruing under 35 U.S.C. §119 from my application entitled INK-JET PRINTER HEAD filed with the Korean Industrial Property Office on Jul. 27, 2000 and there duly assigned Serial No. 2000/43462.

BACKGROUND OF THE INVENTION

1. Field of the Invention

The present invention relates to an ink jet printer head, and more particularly to an ink jet printer head having an ink flow path of improved structure, capable of preventing a backflow of ink which is pushed into the ink flow path during ink discharge through a nozzle hole.

2. Description of the Related Art

Generally, a thermal ink jet printer head discharges and ejects ink through a nozzle hole is in such a manner that a heater resistor instantly heats the ink, generating and expanding ink bubbles. Often, an ink supply path supplies ink to a plurality of ink chambers so that ink can be ejected through nozzle holes in each of the ink chambers. In addition, these plurality of ink chambers are lined up on both sides of the ink supply path. A single channel directly connects the ink supply path to an ink chamber such that the channel enters the ink chamber on the front side (the side of the ink chamber that is adjacent to or faces the ink supply path) of the ink chamber. Under such a simple configuration, during ejection of ink through the nozzle hole, a backflow is produced in the channel and in the ink supply path that can effect the performance of neighboring ink chambers. What is needed is a design of a channel that eliminates the effects of backflow on the ink supply path and on the neighboring ink chambers.

SUMMARY OF THE INVENTION

It is therefore an object of the present invention to provide an ink jet printer head having an ink flow path of improved structure, capable of preventing backflow of ink during ink discharge through a nozzle hole, and thereby improving print quality.

It is also an object of the present invention to provide an improved ink jet printer head.

It is also an object to provide a design of an ink jet printer that eliminates backflow to the ink supply path and to neighboring nozzles upon ejection of ink by one or many nozzle holes.

It is further an object to provide a channel that supplies ink to an ink chamber that enters the ink chamber on the rear side (the side of the ink chamber that is oppositely facing the ink supply line).

It is still yet another object to provide an ink channel with three legs, all at right angles to each other, to supply ink to an ink chamber from an ink supply line.

It is further yet another object to provide varying widths to each of the three legs of the ink channel to absorb the backflow caused during ink ejection.

These and other objects are accomplished by an ink jet printer head including a plurality of nozzle plates having nozzle holes, a plurality of ink chambers symmetrically disposed on both sides of an ink supply path and communicated with nozzle holes, and a plurality of ink channels communicating the ink supply path with the ink chambers, respectively, the ink channels being connected to rear sides of the ink chambers of which front sides face the ink supply path.

According to the ink jet printer head of the present invention as described above, it is preferable that the ink channels include at least one buffer preventing a backflow of ink and more than two ink direction shifting sections.

The object of the present invention is accomplished by the ink jet printer head having a plurality of nozzle plates having nozzle holes, a plurality of ink chambers symmetrically disposed on both sides of an ink supply path, and the ink channels communicating the ink supply path with each ink chamber, the ink channels include a first ink channel formed at a right angle to the ink supply path in parallel relation with the ink chamber, a second ink channel formed at a right angle to the first ink channel in parallel relation with the ink supply path across the ink chamber, and a third ink channel connecting the second ink channel to the rear side of the ink chamber of which front side faces the ink supply path.

According to the ink jet printer head of the present invention as described above, it is preferable that a length of the first ink channel is longer than those of the second and third ink channels, respectively, and a length of the second ink channel is longer than that of the third ink channel.

Also it is preferable that a cross sectional width of the second ink channel is identical to or wider than that of the first ink channel, and a cross sectional width of the first ink channel is identical to or wider than that of the third ink channel.

According to the ink jet printer head of the present invention as described above, the ink jet printer head further includes an ink guiding section and is preferably extended from the ink supply path to the first ink channel, for guiding ink flow. Also it is preferable that a width of the ink channel is narrower than that of a heater resistor disposed inside the ink chamber, and a length of the ink channel is shorter than a half length of a head chip.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
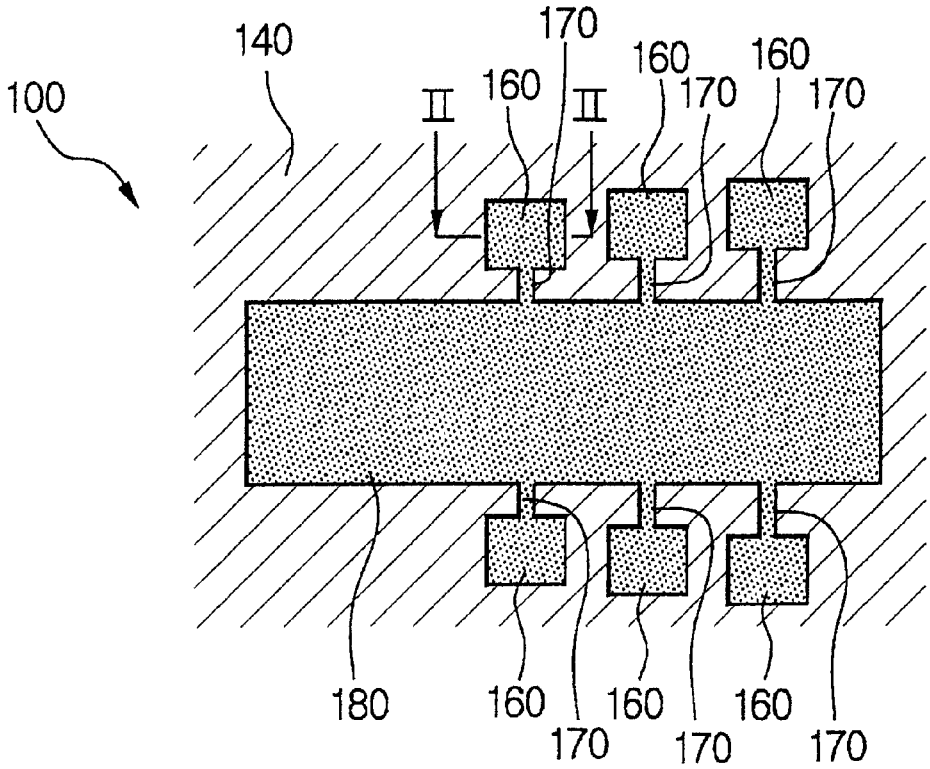
FIG. 1 is a plan view schematically showing an ink flow path of an ink jet printer head.

FIG. 1 shows an ink flow path structure in a thermal ink jet printer head, wherein the ink supply path 180 is communicated with a plurality of ink chambers 160 through ink channels 170. Each ink chamber 160 is surrounded by a nozzle plate (not shown in FIG. 1), an ink chamber barrier 140, and a silicon layer (not shown in FIG. 1), and is communicated with a nozzle hole (not shown in FIG. 1).

Figure 2:
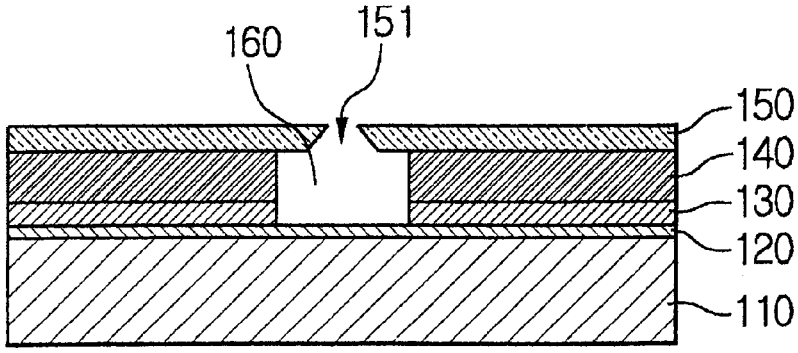
FIG. 2 is a vertical sectional view taken on line II—II of FIG. 1.

FIG. 2 is a cross sectional view taken on line II—II of FIG. 1, for showing a structure of the ink chamber 160. As shown in FIG. 2, a silicon layer 110, a thin-film heater resistor 120, an electrode layer 130 and an ink chamber barrier 140 are layered in succession. A center portion of the electrode layer 130 and ink chamber barrier 140 is etched in a semiconductor fabrication processing such as a photolithography, so that upper surface of the heater resistor 120 can be partially exposed to the etched portion. A nozzle plate 150 having a nozzle hole 151 is layered on the ink chamber barrier 140. The nozzle hole 151 is communicated with the ink chamber 160.

According to the ink jet printer head 100 as constructed above, when the electric power is supplied to the electrode layer 130, the heater resistor 120 instantly heats the ink in the ink chamber 160, generating and expanding ink bubbles. Accordingly, as the expanded ink bubbles pressure the ink chamber 160, the ink is discharged through the nozzle hole 151. The power supplied to the electrode layer 130 is turned off after the ink is discharged, thus the heater resistor 120 is cooled down and the ink bubbles shrink. Then the ink chamber 160 is recharged with ink, and the printing operation is repeated as above.

According to the ink flow path of the ink jet printer head as described above, the ink chamber 160 and the ink supply path 180 are communicated through the ink channel 170. Accordingly, as the ink flows from the ink supply path 180 into the ink chamber 160 which faces the ink supply path 180, a backflow of the ink occurs, i.e., the ink is pushed back into the ink supply path 180 during the ink discharge through the nozzle hole by the expansion pressure of the ink bubbles. The backflow of the ink causes a cross talk during the printing operation, and a serious malfunction such as a detachment of the nozzle plate, thereby hindering ink discharge.

Figure 3:
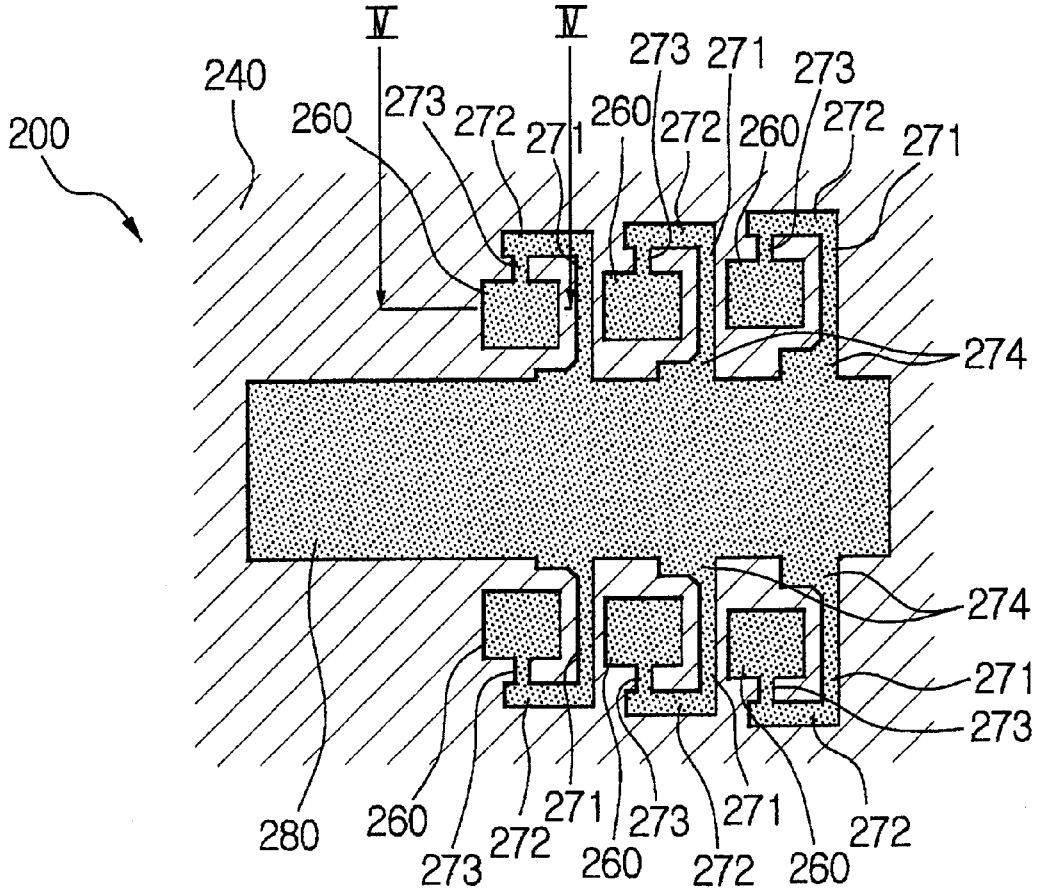
FIG. 3 is a plan view schematically showing an ink flow path of an ink jet printer head according to the present invention.

Referring to FIG. 3, an ink flow path structure of the ink jet printer head 200 according to the present invention includes a plurality of ink chambers 260 symmetrically disposed on both sides of the ink supply path 280, first ink channels 271 connecting the ink supply path 280 with the ink chambers 260, formed at a right angle to the ink supply path 280 in parallel relation with the ink chambers 260, second ink channels 272 formed at a right angle to the first ink channels 271 in parallel relation with the ink supply path 280, and third ink channels 273 connected to rear sides of the ink chambers 260 of which front sides face the ink supply path 280, at a right angle to the second ink channels 272.

According to the present invention, ink guiding sections 274 extend from the ink supply path 280 to the first ink channels 271, for guiding ink flow. An ink in the ink supply path 280 flows through the ink guiding sections 274, the first ink channels 271, the second ink channels 272, the third ink channels 273, and then is charged in the ink chambers 260. Then, the ink is heated in the ink chambers 260, generating and expanding ink bubbles. Accordingly, the ink is discharged through the nozzle holes by expansion pressure and is pushed back into the third ink channels 273. Here, each second ink channel 272 acts as a buffer preventing a backflow of the ink. Therefore, the ink does not flow from the ink chambers 260 back into the first ink channels 271 and the ink supply path 280 during the ink discharge through the nozzle holes 251, due to the second ink channels 272 which act as buffers.

Figure 4:
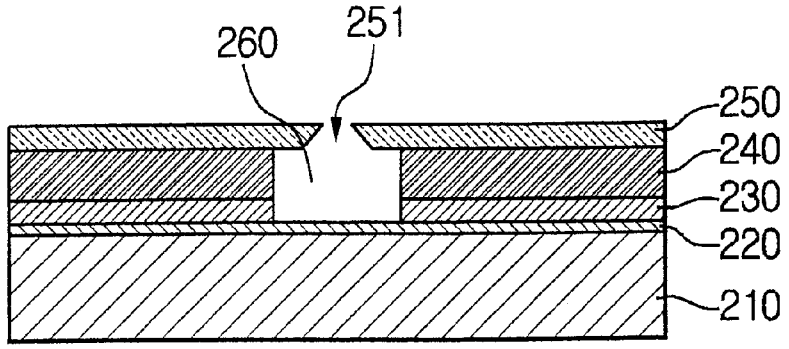
FIG. 4 is a vertical sectional view taken on line IV—IV of FIG. 3.

FIG. 4 is a vertical sectional view taken on line IV—IV of FIG. 3 for showing the structure of the ink chamber 260. As shown in FIG. 4, a silicon layer 210, a thin-film heater resistor 220, an electrode layer 230, and an ink chamber barrier 240 are layered in succession. A center portion of the electrode layer 230 and ink chamber barrier 240 is etched in to partially expose upper surface of the heater resistor 220 thereto. The nozzle plate 250 having the nozzle hole 251 is layered on the ink chamber barrier 240. The nozzle hole 251 is communicated with the ink chamber 260.

According to the ink jet printer head 200 as constructed above, the ink in the ink supply path 280 flows through the ink guiding sections 274, the first ink channels 271, the second ink channels 272, and the third ink channels 273, and then is charged in the ink chambers 260. Then, as the electric power is supplied to the electrode layers 230, the heater resistors 220 instantly heat the ink, generating and expanding ink bubbles. Accordingly, the ink bubbles pressure the ink chambers 260, thus the ink is discharged through the nozzle holes 251. Here, a backflow of ink occurs i.e. the ink is pushed back into the third ink channels 273 due to the expansion pressure of the ink bubbles during the ink discharge. Since the second ink channels 272 act as buffers by reserving the ink flown from the ink chambers 260, the ink does not flow into the first ink channels 271 and the ink supply path 280.

Figure 5:
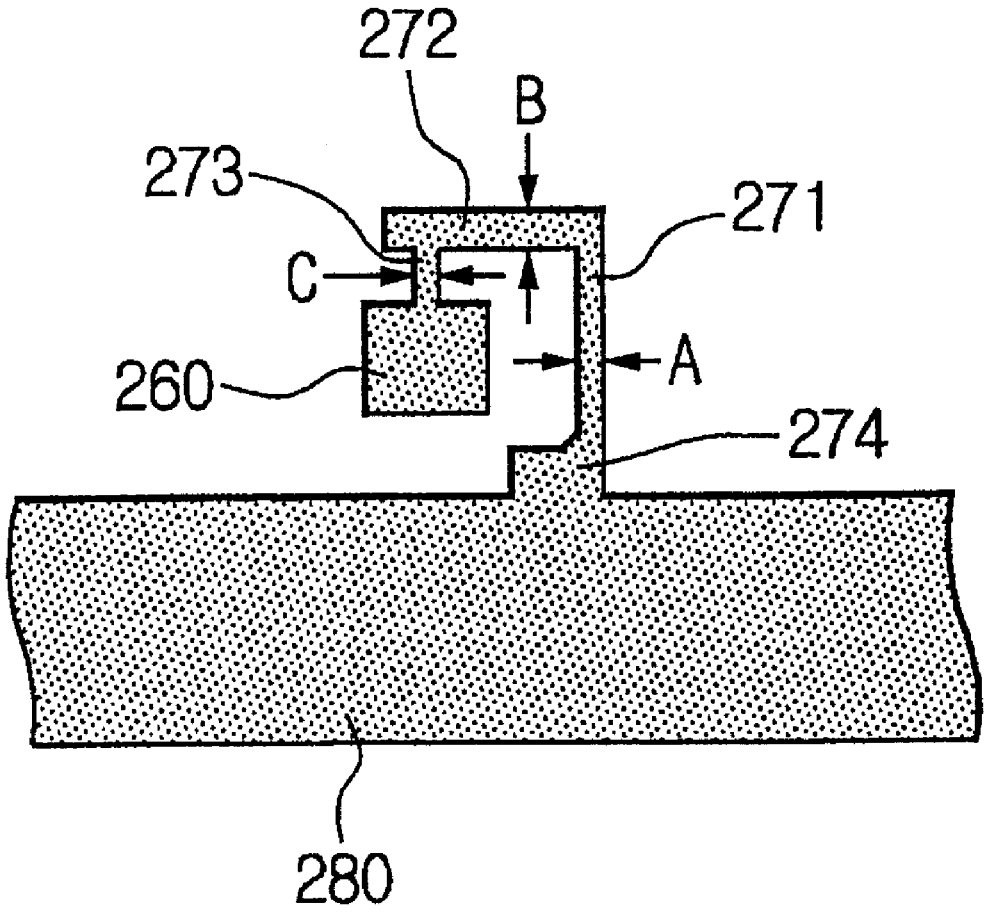
FIG. 5 is a plan view schematically showing major portion of FIG. 3.

As shown in FIG. 5, in order for the second ink channel 272 to act as a buffer in optimum condition, it is preferable that a length of the first ink channel 271 is longer than that of the second ink channel 272 and third ink channel 273, respectively, and a length of the second ink channel 272 is longer than that of the third ink channel 273. Also, it is preferable that a cross sectional width B of the second ink channel 272 is identical to or wider than a cross sectional width A of the first ink channel 271, and the cross sectional width A of the first ink channel 271 is identical to or wider than a cross sectional width C of the third ink channel 273. Also, it is preferable that respective cross sectional widths A, B and C of the first, second and third ink channels 271, 272 and 273 are narrower than a width of a heater resistor (not shown) which is disposed inside the ink chamber 260, and respective lengths of the first, second and third ink channels 271, 272 and 273 are shorter than a half length of a head chip (not shown).

According to the ink jet printer head of the present invention, the third ink channels 273 are connected to rear sides of the ink chambers 260 of which front sides face the ink supply path 280, and the second ink channels 272 reserve the ink which is pushed back from the ink chambers 260 by the expanded ink bubbles during the ink discharge through the nozzle holes 251. Since the second ink channels 272 act as buffers reserving the backflow of ink, and the second and third ink channels 272 and 273 act as ink direction switching sections changing direction of ink flow, the ink does not pushed back into the ink supply path 280.

Accordingly, in the ink jet printer head of the present invention, by varying the length and width of the first, second and third ink channels 271, 272 and 273, the ink discharge can be adequately adjusted and the print quality can be improved. As described above, since the ink flow path of improved structure prevents the backflow of ink and a cross talk during the ink discharge, the print quality can be improved. Also, damages from the backflow of ink such as a detachment of the nozzle plate can be prevented, so that the life time of the ink jet printer head can be prolonged.

The present invention has been particularly shown and described with reference to the preferred embodiment thereof, it will be understood by those skilled in the art that various changes in form and details may be effected therein without departing from the spirit and scope of the invention as defined by the appended claims.

What is claimed is:

1. An ink jet printer head, comprising:

a nozzle plate having a plurality of nozzle holes;

a plurality of ink chambers symmetrically disposed on both sides of an ink supply path, communicating with the nozzle holes; and a plurality of ink channels supplying ink exclusively to respective ones of said plurality of ink chambers disposed at an end of corresponding ones of said plurality of ink channels, the ink channels being connected to rear sides of the ink chambers of which front sides face the ink supply path.

2. The ink jet printer head as claimed in claim 1, wherein each of the ink channels comprises at least one buffer preventing a backflow of ink.

3. The ink jet printer head as claimed in claim 1, wherein each of the ink channels comprises more than two bent sections for switching ink direction.

4. The ink jet printer head as claimed in claim 1, wherein each of the ink channels comprises more than two ink direction switching sections formed at a right angle to one another.

5. The ink jet printer head as claimed in claim 1, further comprising an ink guiding section extended from the ink supply path to the ink channels, guiding an ink flow.

6. The ink jet printer head as claimed in claim 1, wherein a width of each ink channel is narrower than a width of a heater resistor disposed inside the ink chamber.

7. An ink jet printer head, comprising:

a plurality of nozzle plates having nozzle holes;

a plurality of ink chambers symmetrically disposed on both sides of an ink supply path; and a plurality of ink channels communicating the ink supply path with the ink chambers, respectively, the ink channels comprising:

a first ink channel formed at a right angle to the ink supply path in parallel relation with the ink chamber;

a second ink channel formed at a right angle to the first ink channel in parallel relation with the ink supply path across the ink chamber; and a third ink channel formed at a rear side of each ink chamber of which front side faces the ink supply path, for communicating the ink chamber with the second ink channel.

8. The ink jet printer head as claimed in claim 7, wherein a length of the first ink channel is longer than respective lengths of the second and third ink channels.

9. The ink jet printer head as claimed in claim 7, wherein a length of the second ink channel is longer than a length of the third ink channel.

10. The ink jet printer head as claimed in claim 7, wherein a cross sectional width of the second ink channel is identical to or wider than a cross sectional width of the first ink channel.

11. The ink jet printer head as claimed in claim 7, wherein a cross sectional width of the first ink channel is identical to or wider than a cross sectional width of the third ink channel.

12. The ink jet printer head as claimed in claim 7, wherein a cross sectional width of the third ink channel is narrower than a cross sectional width of the second ink channel.

13. The ink jet printer head as claimed in claim 7, further comprising an ink guiding section extended from the ink supply path to the first ink channel, guiding an ink flow.

14. The ink jet printer head as claimed in claim 7, wherein a width of each ink channel is narrower than a width of a heater resistor disposed inside the ink chamber.

15. An ink jet printer head, comprising:

a nozzle plate being perforated by a first plurality of nozzle holes;

a first plurality of ink chambers, each ink chamber having a heater for heating ink in said chamber allowing ejection of a droplet of ink from each of said first plurality of nozzle holes;

an main ink supply path used for delivering ink to each of said first plurality of ink chambers and to replenish each of said first plurality of ink chambers after ejection of ink; and a first plurality of secondary ink supply paths, each one of said first plurality of secondary ink supply paths connecting said main ink supply path to respective ones of said first plurality of ink chambers, each secondary ink supply path, comprising:

a first segment being perpendicular to said main ink supply path and having a first end and a second end opposite to said first end, said first end of said first segment being connecting to said main ink supply path;

a second segment being perpendicular to said first segment and being parallel to said main ink supply path, said second segment having a first end and a second end opposite to said first end, said first end of said second segment being connected to said second end of said first segment; and a third segment having a first end and a second end opposite to said first end, said third segment being perpendicular to said second segment and said main ink supply path, said first end of said third segment being connected to said second end of said second segment and said second end of said third segment being connected to a respective one of said plurality of ink chambers.

16. The ink jet printer of claim 15, said first plurality of ink chambers being symmetrically disposed on both sides of said main ink supply path.

17. The ink jet printer of claim 15, each one of said first plurality of ink chambers having a front side and a rear side opposite to said front side, each one of said first plurality of ink chambers having respective front sides facing said main ink supply path and each one of said first plurality of ink chambers having respective rear sides attached to said second end of corresponding ones of said third segment.

18. The ink jet printer of claim 15, a width of said second segment being equal to or larger than corresponding widths of said first segment and larger than corresponding widths of said third segment.

19. The ink jet printer of claim 18, wherein a width of each one of said first plurality of heaters is smaller than said width of a corresponding one of said first plurality of third segments.

20. The ink jet printer of claim 15, further comprising an ink guiding section at said first end of said first segment to serve as a funnel to supply ink from said main ink supply path into said first segment having a first width.

* * * * *